US009372049B2

(12) United States Patent
Cheng et al.

(10) Patent No.: US 9,372,049 B2
(45) Date of Patent: Jun. 21, 2016

(54) HANDLE SIGHT

(71) Applicants: Carson Cheng, City of Industry, CA (US); Richard Thomas, City of Industry, CA (US)

(72) Inventors: Carson Cheng, City of Industry, CA (US); Richard Thomas, City of Industry, CA (US)

(73) Assignee: NCSTAR, INC., City of Industry, CA (US)

( * ) Notice: Subject to any disclaimer, the term of this patent is extended or adjusted under 35 U.S.C. 154(b) by 11 days.

(21) Appl. No.: 14/295,300

(22) Filed: Jun. 3, 2014

(65) Prior Publication Data

US 2015/0345901 A1 Dec. 3, 2015

(51) Int. Cl.

| | |
|---|---|
| ***F41G 1/00*** | (2006.01) |
| ***F41C 33/08*** | (2006.01) |
| ***F41G 1/08*** | (2006.01) |
| ***F41G 1/30*** | (2006.01) |
| ***F41G 1/387*** | (2006.01) |
| *F41G 11/00* | (2006.01) |

(52) U.S. Cl.

CPC . *F41C 33/08* (2013.01); *F41G 1/08* (2013.01); *F41G 1/30* (2013.01); *F41G 1/387* (2013.01); *F41G 11/003* (2013.01)

(58) Field of Classification Search

CPC ..... F41C 33/08
USPC ..... 42/90, 111; 89/1.42
See application file for complete search history.

(56) References Cited

U.S. PATENT DOCUMENTS

| | | | | |
|---|---|---|---|---|
| 3,166,848 | A * | 1/1965 | Petzsch | 42/142 |
| 3,742,636 | A * | 7/1973 | Dealy et al. | 42/111 |
| 3,777,381 | A * | 12/1973 | Moller et al. | 42/143 |
| 3,939,589 | A * | 2/1976 | Tellie | 42/71.01 |
| 4,663,878 | A * | 5/1987 | Beretta | 42/148 |
| 5,513,461 | A * | 5/1996 | Weldle | 42/71.01 |
| 8,006,425 | B2 * | 8/2011 | Burt et al. | 42/73 |
| 2010/0037505 | A1 * | 2/2010 | Romer | 42/124 |
| 2012/0227304 | A1 * | 9/2012 | Engelhardt | F41G 11/003 42/90 |

OTHER PUBLICATIONS

Nitro.Vo Rail Carrying Handle. <http://web.archive.org/web/20121201195808/http://shop.ehobbyasia.com/nitro-vo-rail-carrying-handle.html>. Dec. 1, 2012.*

Brownells—AR-15 Back-Up Iron Sight/Detachable Carry Handle. Brownells, Inc. <https://www.youtube.com/watch?v=a-CkQIXg7z8>. Jun. 13, 2012.*

* cited by examiner

*Primary Examiner* — Gabriel Klein
(74) *Attorney, Agent, or Firm* — Raymond Chan

(57) ABSTRACT

A handle sight for a firearm includes a mounting base and a carrying handle. The mounting base has an elongated shape and defining a first end portion and an opposed second end portion, wherein the mounting base is adapted for detachably mounting on the firearm in a reversible orientation to locate the first end portion of the mounting base one of a forward direction and a rearward direction of the firearm. The carrying handle is upwardly extended from the first end portion of the mounting base at a top side thereof, wherein the carrying handle has a hollow structure to define a sight channel for parallelly align with a barrel axis of the firearm so as to enable an operator to aim at a front iron sight of the firearm through the sight channel.

19 Claims, 5 Drawing Sheets

HANDLE SIGHT

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a firearm accessory, and more particular to a handle sight, which is adapted for detachably coupling at a firearm not only to provide an added-on firearm carrying handle but also to incorporate an existing sight module.

2. Description of Related Arts

Conventional firearm, especially for a rifle, usually does not include any carrying handle since different firearm accessories, such as a sight module, is mounted on the firearm for assisting the operator to accurately locate the target and perform the shooting. Accordingly, the carrying handle is mounted on top of the firearm, such that the carrying handle will occupy the top side of the firearm. It is known that the sight module, such as a scope, reflex sight, telescope, camera lens module, or binoculars, generally comprises a lens housing mounted on the top side of the firearm. As a result, the carrying handle and the sight module are mounted at different locations on the top side of the firearm. It is worth mentioning that the sight module must be mounted on the firearm to parallel to the barrel axis of the firearm. In other words, when the sight module is mounted on top of the firearm, the carrying handle will block the view of the sight module.

SUMMARY OF THE PRESENT INVENTION

The invention is advantageous in that it provides a handle sight, which is adapted for detachably coupling at a firearm not only to provide an added-on firearm carrying handle but also to incorporate an existing sight module.

Another advantage of the invention is to provide a handle sight, which can be detachably mounted on the firearm in a reversible orientation, per user's preferences.

Another advantage of the invention is to provide a handle sight, wherein the carrying handle has a sight channel for parallelly align with a barrel axis of the firearm to enable an operator to aim at a front iron sight of the firearm through the sight channel.

Another advantage of the invention is to provide a handle sight, wherein the foldable iron can be upwardly folded for aligning with the front iron sight of the firearm and can be downwardly folded flat on the mounting base.

Another advantage of the invention is to provide a handle sight, wherein the carrying handle further has an indented laser channel indentedly formed on the top platform for enabling a laser beam to alignedly pass along the laser channel.

Another advantage of the invention is to provide a handle sight, wherein the mounting base comprises an attachment platform for detachably coupling with a firearm accessory.

Another advantage of the invention is to provide a handle sight, which does not require altering the original mounting structure of the firearm, so as to minimize the manufacturing cost of the handle sight incorporating with the firearm.

Another object of the present invention is to provide a handle sight, wherein no expensive or complicated structure is required to employ in the present invention in order to achieve the above mentioned objects. Therefore, the present invention successfully provides an economic and efficient solution for providing multiple functional configurations to minimize additional firearm accessories on the firearm.

Additional advantages and features of the invention will become apparent from the description which follows, and may be realized by means of the instrumentalities and combinations particular point out in the appended claims.

According to the present invention, the foregoing and other objects and advantages are attained by a handle sight which comprises a mounting base and a carrying handle.

The mounting base has an elongated shape and defining a first end portion and an opposed second end portion, wherein the mounting base is adapted for detachably mounting on the firearm in a reversible orientation to locate the first end portion of the mounting base one of a forward direction and a rearward direction of the firearm.

The carrying handle is upwardly extended from the first end portion of the mounting base at a top side thereof, wherein the carrying handle has a hollow structure to define a sight channel for parallelly align with a barrel axis of the firearm so as to enable an operator to aim at a front iron sight of the firearm through the sight channel.

In accordance with another aspect of the invention, the present invention comprises a handle sight for a firearm, which comprises a mounting base, a carrying handle, and a foldable iron sight.

The mounting base has an elongated shape and defining a first end portion and an opposed second end portion, wherein the mounting base is adapted for detachably mounting on the firearm.

The carrying handle is upwardly extended from the first end portion of the mounting base at a top side thereof, wherein the carrying handle has a hollow structure to define a sight channel for parallelly align with a barrel axis of the firearm so as to enable an operator to aim at a front iron sight of the firearm through the sight channel.

The foldable iron sight, having an aperture sight, is upwardly extended from the top side of the mounting base, wherein the foldable iron sight is folded upwardly from the top side of said mounting base for aligning with the front iron sight of the firearm and is downwardly folded flat on the top side of the mounting base.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
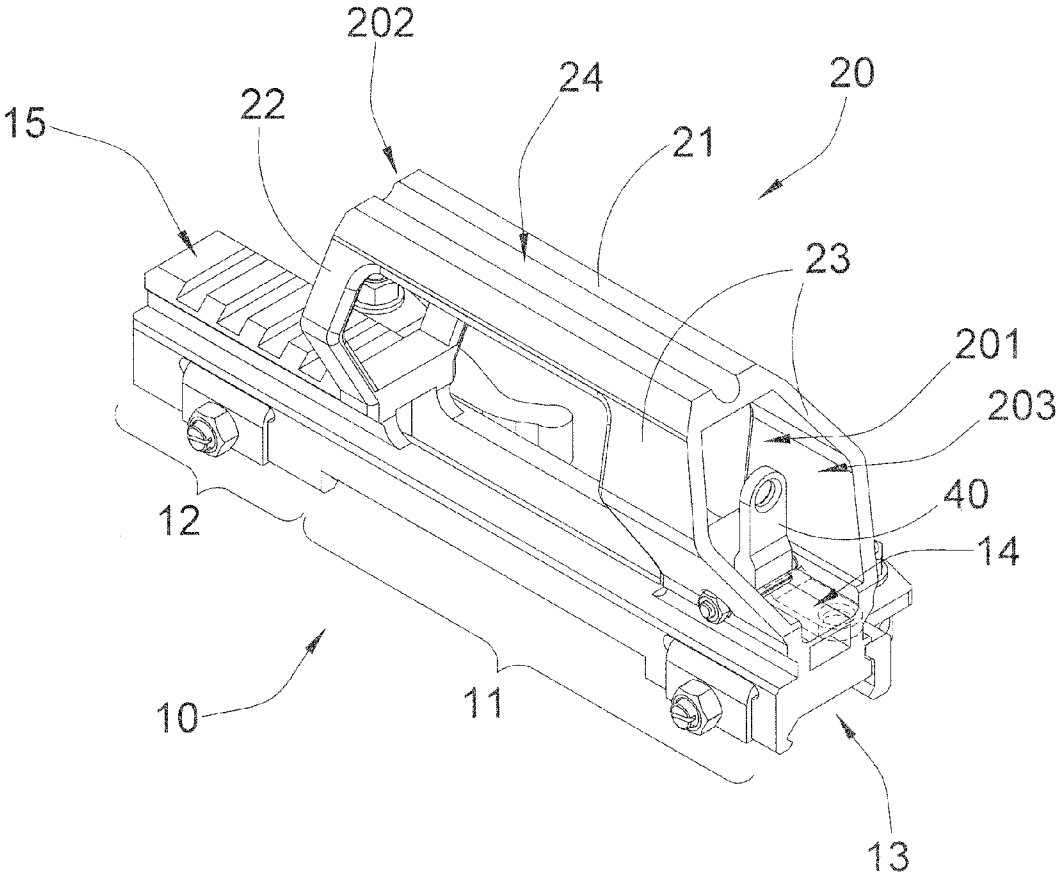
FIG. 1 is a perspective view of a handle sight according to a preferred embodiment of the present invention.

Referring to FIG. 1 of the drawings, a handle sight according to a preferred embodiment of the present invention is illustrated, wherein the handle sight, which is adapted for detachably mounting on a firearm such as a rifle, comprises a mounting base 10 and a carrying handle 20.

Figure 2A:
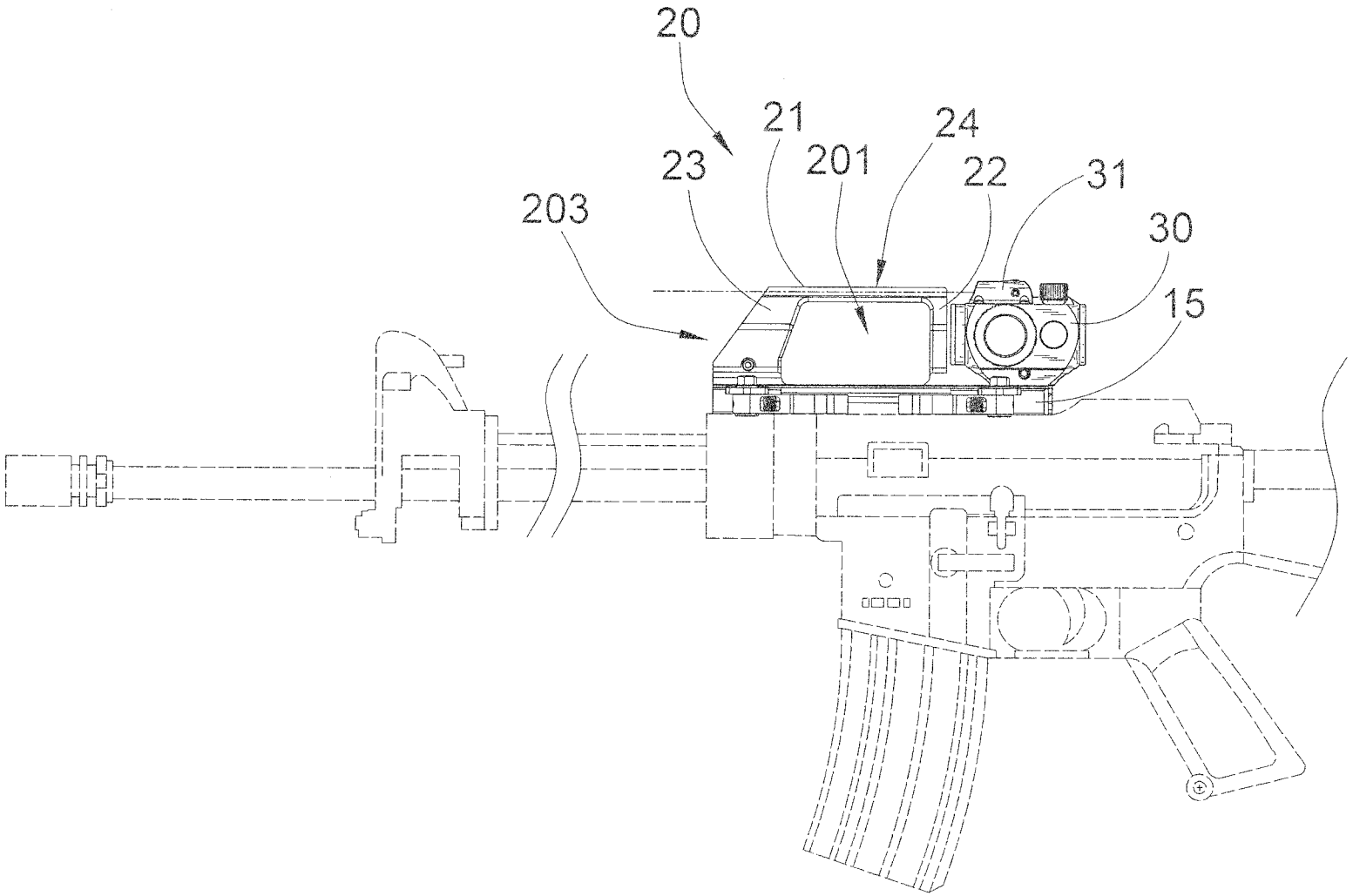
FIGS. 2A and 2B are side view of the handle sight according to the above preferred embodiment of the present invention, illustrating the handle sight to be detachably mounted on the firearm in a reversible orientation.
Figure 2B:
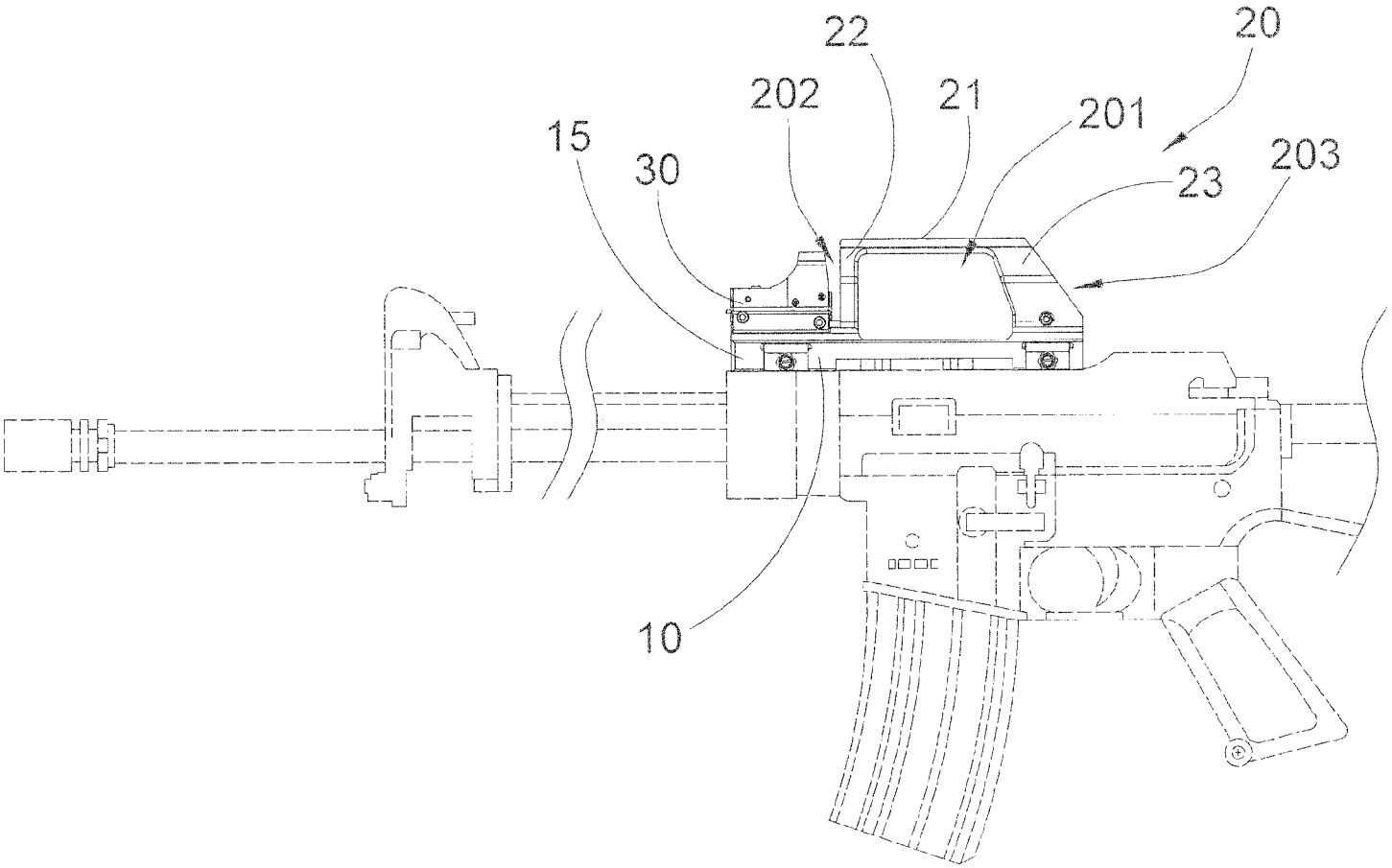

The mounting base 10 has an elongated shape and defining a first end portion 11 and an opposed second end portion 12, wherein the mounting base 10 is adapted for detachably mounting on the firearm in a reversible orientation. Accordingly, the mounting base 10 can be mounted on the firearm to locate the first end portion 11 of the mounting base 10 in a forward direction of the firearm, as shown in FIG. 2A, or to locate the first end portion 11 of the mounting base 10 in a rearward direction of the firearm, as shown in FIG. 2B. The forward direction of the firearm is the direction where the barrel is pointing, and the rearward direction of the firearm is the direction opposite to the barrel direction.

The carrying handle 20 is upwardly extended from the first end portion 11 of the mounting base 10 at a top side thereof, wherein the carrying handle 20 has a hollow structure to define a sight channel 201 for parallelly align with a barrel axis of the firearm so as to enable an operator to aim at a front iron sight of the firearm through the sight channel 201.

As shown in 4, the mounting base 10 further comprises a dual locking arrangement 13 extended from a bottom side of the mounting base 10 for detachably mounting the mounting base 10 on the firearm in a reversible orientation, wherein the mounting base 10 is parallelly aligned with the barrel axis of the firearm. Accordingly, the dual locking arrangement 13 comprises a mounting rail 131 downwardly extended from the mounting base 10 and a mounting arrangement 132 provided at the mounting rail 131 for detachably attaching onto the top rail of the firearm. The mounting rail 131 can be configured to have a "Weaver" mounting structure, a "Picatinny" mounting structure, or "KeyMod" mounting structure to detachably couple at the firearm. Preferably, the mounting arrangement 132 is a quick releasing mount comprising two locking levers 133 to rapidly lock and unlock the mounting rail 131 at the top rail of the firearm.

Figure 3:
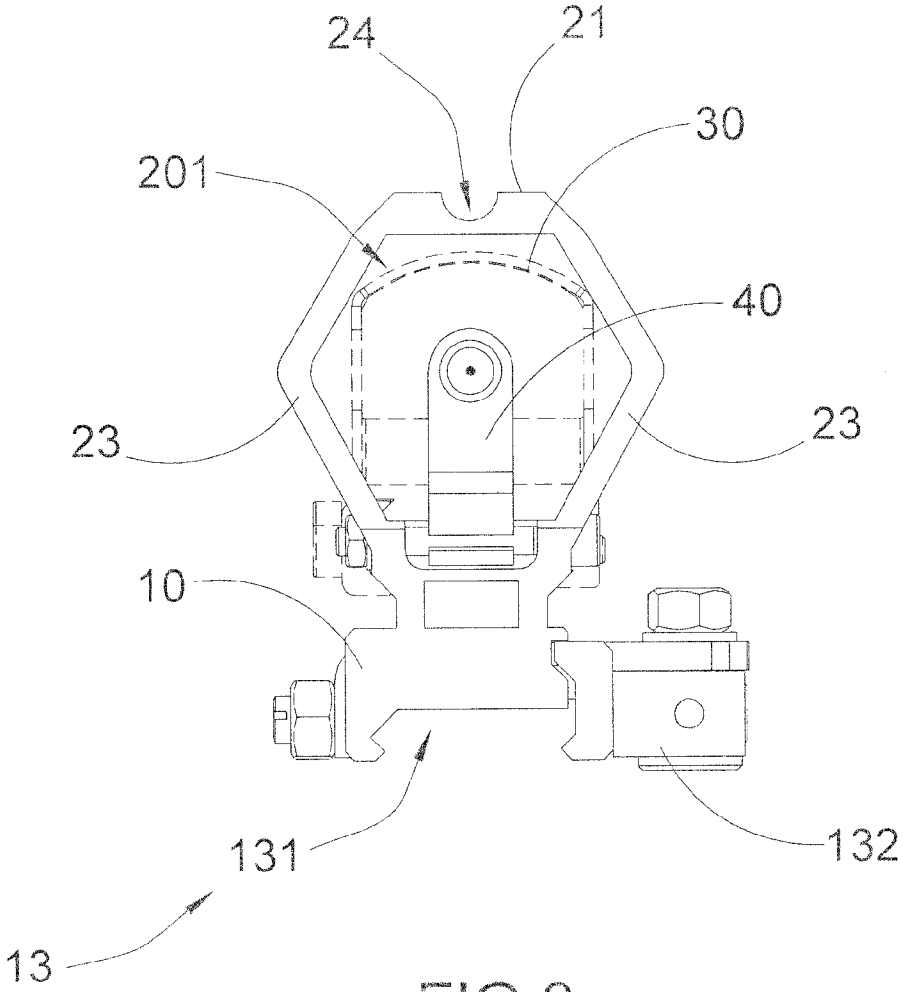
FIG. 3 is a rear view of the handle sight according to the above preferred embodiment of the present invention.

The mounting base 10 further comprises an attachment platform 15 formed on the top side of the mounting base 10 at the second end portion 12 for detachably coupling with a firearm accessory. As shown in FIGS. 2A and 2B, a sight module 30, such as reflex sight, is detachably coupled on the attachment platform 15 of the mounting base 10. Accordingly, when the mounting base 10 is mounted on the firearm in a forward direction, the sight module 30 is mounted on the attachment platform 15 behind the carrying handle 20. However, the operator is able to view the reticle of the sight module 30 through the sight channel 201 without being blocked by the carrying handle 20. When the mounting base 10 is mounted on the firearm in a rearward direction, the sight module 30 is mounted on the attachment platform 15 in front of the carrying handle 20. Through the sight channel 201, the operator is able to view the reticle of the sight module 30. In other words, the operator is able to view the reticle of the sight module when the mounting base 10 is mounted in either forward or rearward direction, as shown in FIG. 3. For example, the operator is able to aim the firearm at a target with the reflex optic dot reticle through the sight channel 201 of the carrying handle 20. It is worth mentioning that the reflex optic dot reticle of the sight module 30 is aligned with the front iron sight of the firearm for being used as an aiming/targeting system for the firearm. Therefore, the sight module 30 is arranged to co-witness with the front iron sight of the firearm. It is worth mentioning that different sight modules, such as scope, flashlight, or camera lens module, can be selectively mounted on the attachment platform 15 according to the need of the operator.

As shown in FIGS. 1, 2A, 2B, and 4, the carrying handle 20 comprises a top platform 21, two first leg frames 22 spacedly extended from the top platform 21 to the top side of the mounting base 10 to define a first sight opening 202 of the sight channel 201 within the top platform 21 and the first leg frames 22, and two second leg frames 23 spacedly and inclinedly extended from the top platform 21 to the top side of the mounting base 10 to define an opposed enlarged second sight opening 203 of the sight channel 201 within the top platform 21 and the second leg frames 23. In other words, the sight channel 201 is formed between the top platform 21 and the top side of the mounting base 10 at the first end portion 11 thereof.

As shown in FIGS. 2A and 2B, the first leg frames 22 are vertically extended from the top side of the mounting base 10 to the top platform 21 to define a vertical flat surface to maximize the mounting area of the attachment platform 15 for supporting the sight module 30 thereon.

The second leg frames 23 are inclinedly extended from a first end of the mounting base 10 to the top platform 21 such that the carrying handle 20 has a trapezoid cross section. In other words, the longitudinal length of the top platform 21 is shorter than the longitudinal length of the first end portion 11 of the mounting base 10. It is worth mentioning that since the second leg frames 23 are extended inclinedly, the area of the second sight opening 203 will be enlarged. Accordingly, an accessing window is formed between the first and second leg frames 22, 23 to communicate with the sight channel 201, such that the fingers of the operator can insert into the sight channel 201 through the accessing windows and grip at the top platform 21 in order to carry the firearm via the carrying handle 20.

Figure 4:
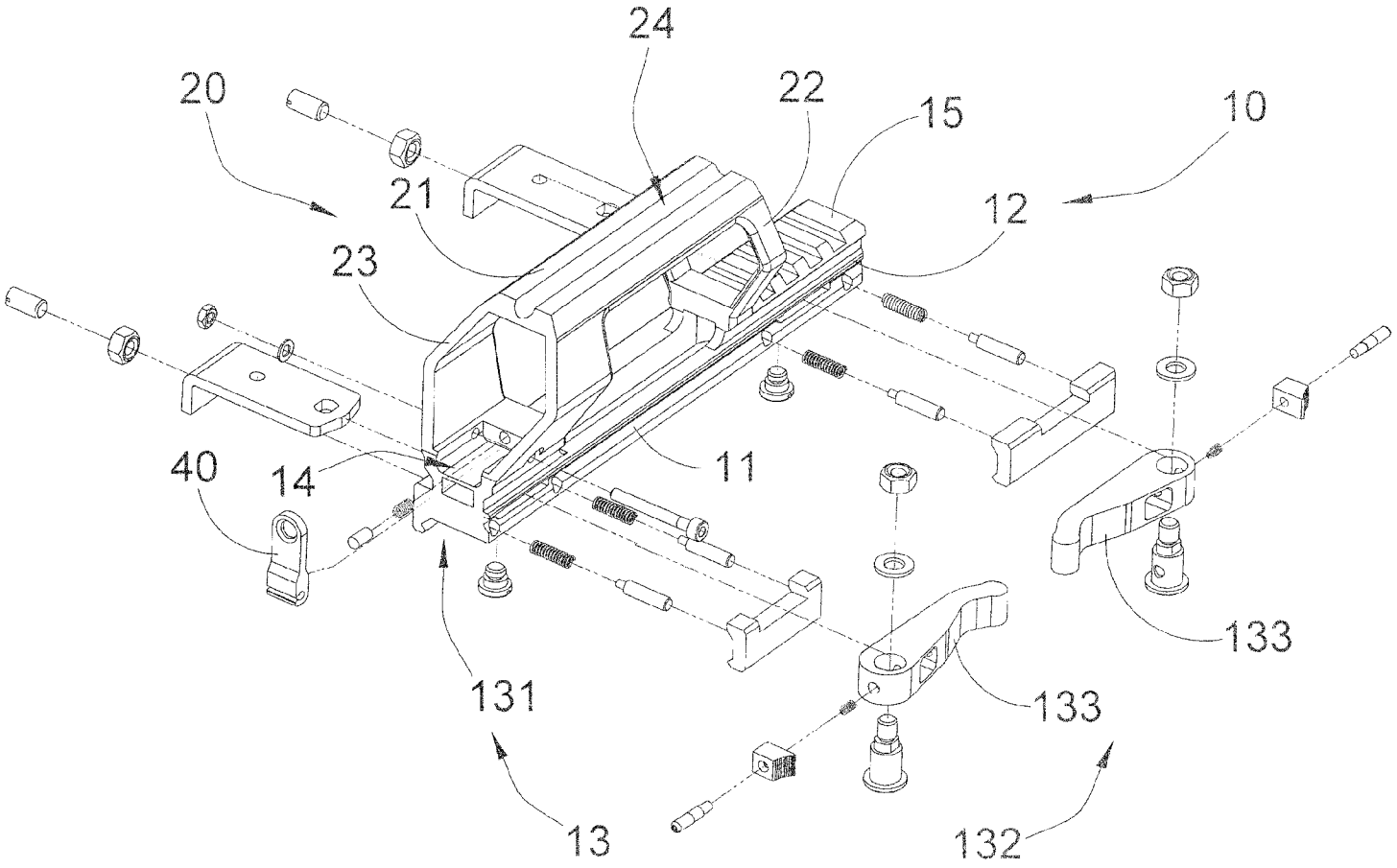
FIG. 4 is an exploded perspective view of the handle sight according to the above preferred embodiment of the present invention.

As shown in FIGS. 1 and 4, the carrying handle 20 further has an indented laser channel 24 indentedly formed on the top platform 21 for enabling a laser beam to alignedly pass along the laser channel 24. Accordingly, the laser channel 24 is longitudinal indented on the top platform 21 edge-to-edge. When the sight module 30 is mounted at the on the attachment platform 15, the sight module 30 will generate the laser beam. Therefore, the laser channel 24 is a clearance channel on top of the top platform 21 to allow the laser beam to pass over the carrying handle 20 to allow the operator to use the laser beam to aim the firearm. In particular, the sight module 30 can be a reflex optic integrated with a laser generator 31, as shown in FIG. 2A, that provides the reflex optic dot reticle to be viewed through the sight channel 201 and generate the laser beam aligning with the laser channel 24.

It is worth mentioning that the carrying handle 20 and the sight module 30 are provided at the first and second end portions 11, 12 of the mounting base 10 respectively, the sight module 30 is not mounted within the sight channel 201. However, the operator is able to view the sight module 30 through the sight channel 201. In addition, even though the sight module 30 is coupled on the mounting base 10, the operator is able to carrying the firearm via the carrying handle 20 without being blocked by the sight module 30.

As shown in FIGS. 1, 3 and 4, the handle sight further comprises a foldable iron sight 40, having an aperture sight, upwardly extended from the top side of the mounting base 10, wherein the foldable iron sight 40 is folded upwardly from the top side of the mounting base 10 for aligning with the front iron sight of the firearm and is downwardly folded flat on the top side of the mounting base 10.

Accordingly, the foldable iron sight 40 is pivotally coupled at the first end portion 11 of the mounting base 10 within the sight channel 201. In particular, the foldable iron sight 40 is foldably coupled at the enlarged second sight opening 203 of the sight channel 201. It is worth mentioning that with the enlarged area of the second sight opening 203, the operator is able to easily fold the foldable iron sight 40 to upwardly extend from the top side of the mounting base 10.

Accordingly, a bottom end of the foldable iron sight 40 is pivotally coupled on the top side of the mounting base 10, wherein the foldable iron sight 40 is upwardly and pivotally toward the second end portion 12 of the mounting base 10 that the folding iron sight 40 is perpendicularly extended from the top side of the mounting base 10. It is worth mentioning that the aperture sight of the foldable iron sight 40 is aligned with the front iron sight of the firearm when the foldable iron sight 40 is folded upwardly. Once the foldable iron sight 40 is upwardly and pivotally flipped, the foldable iron sight 40 at the same plain as the sight module 30 to allow co-witnessing the sight module 30 and the foldable iron sight 40 together at the same time and height. It is worth mentioning that the foldable iron sight 40 can incorporate with the front iron sight of the firearm and can serve as a back-up iron sighting system for the firearm if the sight module 30 is malfunction, such as out of battery.

As shown in FIGS. 1 and 4, the mounting base 10 has an indented cavity 14 formed on the top side of the mounting base 10 and extended to the first end thereof, wherein a depth of the indented cavity 14 is at least equal to the thickness of the foldable iron sight 40, such that the foldable iron sight 40 is folded flat in the indented cavity 14 to align with the top side of the mounting base 10. In other words, when the foldable iron sight 40 is downwardly folded, the foldable iron 40 is folded into the indented cavity 14 and is embedded in the top side of the mounting base 10. Therefore, once the foldable iron sight 40 is pivotally and downwardly flipped, the sight channel 201 will provide a clear field of view when using the sight module 30 as the primary aiming device.

Accordingly, the handle sight of the present invention not only provides a carrying means for the firearm via the carrying handle 20 without blocking the aiming of the front iron sight of the firearm but also forms an adapter to incorporate with the sight module 30 to be mounted on the firearm for co-witnessing with the front iron sight of the firearm. Therefore, the handle sight of the present invention offers multiples features into one single structure for the firearm.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A handle sight for a firearm having a front iron sight, comprising:

a mounting base forming in an elongated shape and having a first end portion and an opposed second end portion, wherein each of said first and second end portions of said mounting base are adapted for detachably mounting on said firearm in both a forward direction and a rearward direction;

a carrying handle which comprises a top platform upwardly supported above a top side of said first end portion of said mounting base to form a sight channel between a bottom side of said top platform and a top side of said mounting base, wherein said sight channel, having a first sight opening and an opposed second sight opening, is an elongated through channel for parallelly aligning with a barrel axis of the firearm so as to enable an operator to aim the front iron sight of the firearm through said sight channel, wherein said carrying handle further has an elongated indented laser channel formed on a top side of said top platform, wherein said mounting base further comprises an attachment platform formed at said top side of said mounting base at said second end portion thereof;

a sight module detachably coupled at said attachment platform of said mounting base for generating a laser beam, wherein when said mounting base is mounted in the forward direction, said sight module is mounted on said attachment platform behind said carrying handle, such that the laser beam of said sight module alignedly passes through said laser channel of said carrying handle, wherein when said mounting base is mounted in the rearward direction, said sight module is mounted on said attachment platform in front of said carrying handle; and a foldable iron sight, having an aperture sight, upwardly extended from said top side of said mounting base at a position below said top platform, wherein when said sight module is detached from said attachment platform, said foldable iron sight is configured to be folded upwardly from said top side of said mounting base for aligning with the front iron sight of the firearm through said sight channel and is further configured to be downwardly folded flat on said top side of said mounting base.

2. The handle sight, as recited in claim 1, wherein said mounting base has an indented cavity formed on said top side of said mounting base and extended to a first end thereof, wherein said foldable iron sight is pivotally coupled at said mounting base within said sight channel and is folded flat in said indented cavity to align with said top side of said mounting base.

3. The handle sight, as recited in claim 2, wherein said carrying handle further comprises two first leg frames spacedly extended from said top platform to said top side of said mounting base to define said first sight opening of said sight channel between said first leg frames, and two second leg frames spacedly extended from said top platform to said top side of said mounting base to define said second sight opening of said sight channel between said second leg frames, wherein said second leg frames are inclinedly extended between said top platform and said mounting base to enlarge an area of said second sight opening of said sight channel.

4. The handle sight, as recited in claim 3, wherein said foldable iron sight is foldably coupled at said second sight opening of said sight channel.

5. The handle sight, as recited in claim 4, wherein a longitudinal length of said top platform is shorter than a longitudinal length of said first end portion of said mounting base.

6. The handle sight, as recited in claim 5, wherein said first leg frames are vertically extended from said top side of said mounting base to said top platform to define a vertical flat surface to maximize a mounting area of said attachment platform for supporting the sight module thereon.

7. The handle sight, as recited in claim 5, wherein said carrying handle further has an accessing window formed between said first and second leg frames to communicate with said sight channel for allowing the operator to grip at said top platform through said accessing window so as to carry the firearm via said carrying handle.

8. The handle sight, as recited in claim 7, wherein said first leg frames are vertically extended from said top side of said mounting base to said top platform to define a vertical flat surface to maximize a mounting area of said attachment platform for supporting the sight module thereon.

9. The handle sight, as recited in claim 3, wherein said laser channel is indentedly formed on said top side of said top platform for enabling the laser beam to alignedly pass along said laser channel, wherein said sight module comprises a reflex optic integrated with a laser generator and said sight module generates the laser beam to alignedly pass through said laser channel and generates a reflex optic dot reticle to be viewed through said sight channel.

10. The handle sight, as recited in claim 3, wherein said mounting base further comprises two locking levers spacedly formed at a bottom side of said mounting base for detachably coupling said mounting base on the firearm in a reversible orientation while said sight channel is remained at a position for parallelly aligning with the barrel axis of the firearm and for aligning with the front iron sight of the firearm through said sight channel.

11. The handle sight, as recited in claim 1, wherein said carrying handle further comprises two first leg frames spacedly extended from said top platform to said top side of said mounting base to define said first sight opening of said sight channel between said first leg frames, and two second leg frames spacedly extended from said top platform to said top side of said mounting base to define said second sight opening of said sight channel between said second leg frames, wherein said second leg frames are inclinedly extended between said top platform and said mounting base to enlarge an area of said second sight opening of said sight channel.

12. The handle sight, as recited in claim 11, wherein said foldable iron sight is foldably coupled at said second sight opening of said sight channel.

13. The handle sight, as recited in claim 11, wherein a longitudinal length of said top platform is shorter than a longitudinal length of said first end portion of said mounting base.

14. The handle sight, as recited in claim 13, wherein said first leg frames are vertically extended from said top side of said mounting base to said top platform to define a vertical flat surface to maximize a mounting area of said attachment platform for supporting the sight module thereon.

15. The handle sight, as recited in claim 13, wherein said laser channel is indentedly formed on said top side of said top platform for enabling the laser beam to alignedly pass along said laser channel, wherein said sight module comprises a reflex optic integrated with a laser generator and said sight module generates the laser beam to alignedly pass through said laser channel and generates a reflex optic dot reticle to be viewed through said sight channel.

16. The handle sight, as recited in claim 15, wherein said mounting base further comprises two locking levers spacedly formed at a bottom side of said mounting base for detachably coupling said mounting base on the firearm in a reversible orientation while said sight channel is remained at a position for parallelly aligning with the barrel axis of the firearm and for aligning with the front iron sight of the firearm through said sight channel.

17. The handle sight, as recited in claim 11, wherein said carrying handle further has an accessing window formed between said first and second leg frames to communicate with said sight channel for allowing the operator to grip at said top platform through said accessing window so as to carry the firearm via said carrying handle.

18. The handle sight, as recited in claim 1, wherein said laser channel is indentedly formed on said top side of said top platform for enabling the laser beam to alignedly pass along said laser channel, wherein said sight module comprises a reflex optic integrated with a laser generator and said sight module generates the laser beam to alignedly pass through said laser channel and generates a reflex optic dot reticle to be viewed through said sight channel.

19. The handle sight, as recited in claim 1, wherein said mounting base further comprises two locking levers spacedly formed at a bottom side of said mounting base for detachably coupling said mounting base on the firearm in a reversible orientation while said sight channel is remained at a position for parallelly aligning with the barrel axis of the firearm and for aligning with the front iron sight of the firearm through said sight channel.

* * * * *